United States Patent [19]

Crews et al.

[11] 4,101,900

[45] Jul. 18, 1978

[54] MODIFIED T-BAR FED SLOT ANTENNA

[75] Inventors: Michael R. Crews, Charlotte, N.C.; Gary A. Thiele, Columbus, Ohio

[73] Assignee: The United States of America as represented by the Secretary of the Navy, Washington, D.C.

[21] Appl. No.: 772,808

[22] Filed: Feb. 28, 1977

[51] Int. Cl.[2] ..... H01Q 1/28

[52] U.S. Cl. ..... 343/789; 343/769; 343/767

[58] Field of Search ..... 343/767, 789, 769, 846, 343/700 MS

[56] References Cited

U.S. PATENT DOCUMENTS 3,778,717 12/1973 Okoshi et al. ..... 343/700 MS

*Primary Examiner*—Alfred E. Smith
*Assistant Examiner*—David K. Moore
*Attorney, Agent, or Firm*—Richard S. Sciascia; Arthur A. McGill; Prithvi C. Lall

[57] ABSTRACT

A rectangular antenna has a T-bar of planar cross section for providing a coaxial to cavity transition. A narrow slot having a length equal to one half the wavelength of the upper end point of the frequency range utilized is centered within the T-bar. Tuning stubs are located in predetermined positions directly under the T-bar for reducing the effect of the $TE_{30}$ mode.

4 Claims, 5 Drawing Figures

MODIFIED T-BAR FED SLOT ANTENNA

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

The present invention generally relates to antennas and more particularly toward the electrical improvement and size reduction of T-bar fed slot antennas.

In a previous study, sponsored by the Navy, E. H. Newman concluded that in T-bar fed slot antennas, T-bars of thin rectangular cross section exhibit essentially the same input impedance as T-bars of circular cross section, but that the T-bar geometry is one of the important parameters of bandwidth performance. Bandwidth was considered, by Newman, to be that frequency range where the VSWR of the antenna remains below 2.0.

However, other important performance parameters such as efficiency, gain, and radiation patterns are also suitable for evaluation in terms of bandwidth. An experimental system was devised that would sample each of the performance parameters simultaneously as the antenna parameters were varied and would quickly describe these interrelationships.

SUMMARY OF THE INVENTION

Accordingly, it is a general purpose and object of the present invention to provide an improved slot antenna. It is a further object to provide a slot antenna of improved electrical performance and reduced size. These and other objects of the invention and the various features and details of construction and operation will become apparent from the specification and drawings.

The slot antenna possesses a wide bandwidth of 500 to 2000 MHz while having satisfactory Voltage Standing Wave Ratio and far field patterns. The antenna exhibits certain pattern properties such as having the pattern maximum normal to the center of the slot. In addition the cavity requires a depth of no more than 1.5 inches.

DESCRIPTION OF THE PREFERRED EMBODIMENT

Figure 1:
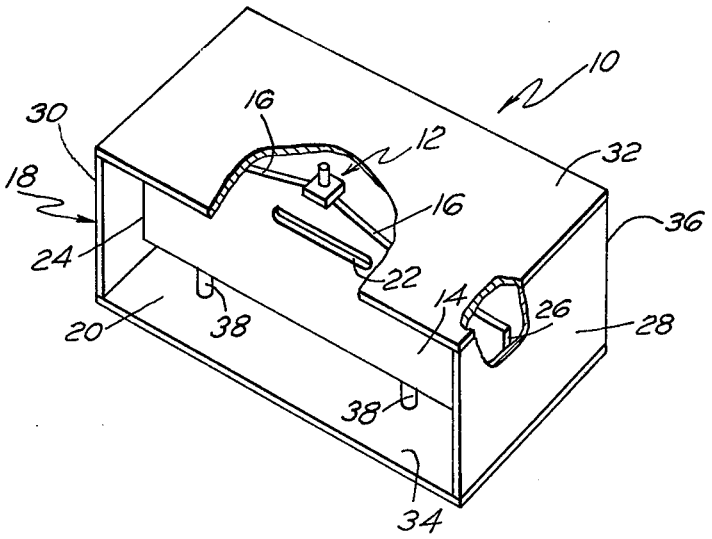
FIG. 1 is a view of a T-bar fed slot antenna in accordance with the present invention.

Referring now to FIG. 1 there is generally shown a cavity backed T-bar slot antenna 10. A coaxial connector 12 is affixed to planar cross section T-bar 14. T-bar 14 has a gradual sloping side 16 extending down and away from connector 12. A rectangular waveguide segment 18 forming a cavity has an aperture 20 on a side that is parallel to planar T-bar 14. The waveguide 18 has opposite sides 28 and 30, a top 32, a bottom 34, and a back wall 36. A narrow slot 22 is centered on planar T-bar 14 between opposing ends 24 and 26. The length of slot 22 is equal to $\lambda_{Hf}/2$, wherein $\lambda_{HF}$ is the wavelength of the upper endpoint of the frequency range. In the present case with the highest frequency being 2000 MHz the optimum slot length is 7.5 cm. The slot 22 affects only the bandwidth above 1500 MHz and the insertion loss shows greatest improvement at 2000 MHz. A slot 22 having a geometry that is narrow rectangular with rounded corners offers optimum performance.

Tuning stubs 38 are located $\pm \lambda_{30}/2$ from the center of the aperture 20 directly under the T-bar. $\lambda_{30}$ is the wavelength of the frequency where the $TE_{30}$ mode is excited. The tuning stubs 28 reduce the effect of the $TE_{30}$ mode. In the present embodiment the best performance was achieved when the tuning stubs were located $\pm$ 10 cm from the center of the aperture which corresponds to a spacing of one wavelength at the troublesome frequency of 1500 MHz.

Reducing the cavity to $\lambda_{HF}/4$ results in loss of performance on the low end but a nearly equal increase occurs on the high end of the bandwidth. Test results also indicate that the cavity depth may be decreased by decreasing the T-bar depth while maintaining the distance from T-bar to cavity shorting plate.

In the present antenna 10, the aperture 20 length, which is the distance from the inner sides of walls 28 and 30 is 12.0 inches. The aperture width, which is the distance from the inner sides of walls 32 and 34 is 4.0 inches. The position of the slot 22 is 4 centimeters above the inner wall 34.

Figure 2:
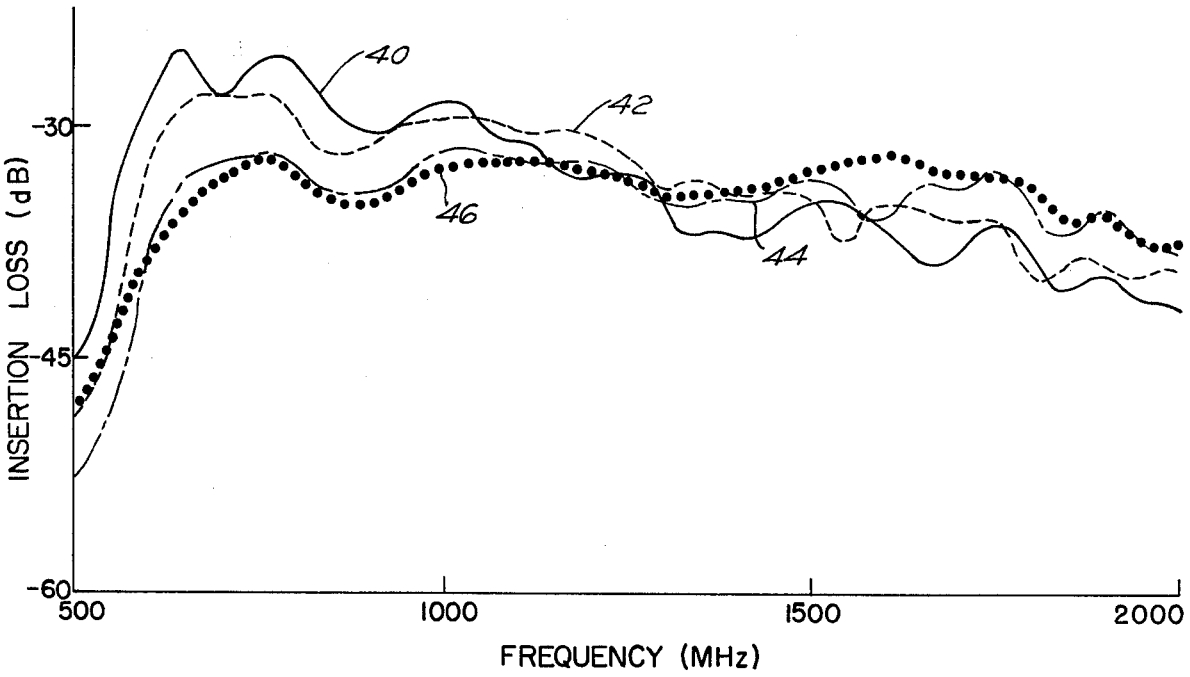
FIG. 2 shows a comparison of the insertion loss measurement of 3 different size and arrangement configurations of FIG. 1 with a log-periodic antenna.

FIG. 2 shows a comparison of the insertion loss measurements between the T-bar antenna 10 of various cavity depths and a log periodic antenna of comparable bandwidth. Curve 40 shows the insertion loss measured with a log periodic antenna. Curve 42 shows the measurement with a cavity depth of 2.125 inches and a distance of 0.75 inches from the aperture plane 20 to the T-bar probe 14. The cavity depth is the measurement from the aperture plane 20 to the back wall 36. Curve 44 shows the measurement with a cavity depth of 1.5 inches and a distance of 0.75 inches from the aperture plane 20 to the T-bar probe 14. Curve 46 is a measurement with a cavity depth of 1.125 inches and a distance of 0.1875 inches from the aperture plane 20 to the T-bar probe 14. Results indicate that T-bar performance is equal to or better than the log periodic antenna at a cavity depth of 2.125 inches. The isotropic gain of the T-bar fed slot antenna 10 shown in FIG. 1 has reasonable performance considering the physical size of the antenna 10.

Figure 3:
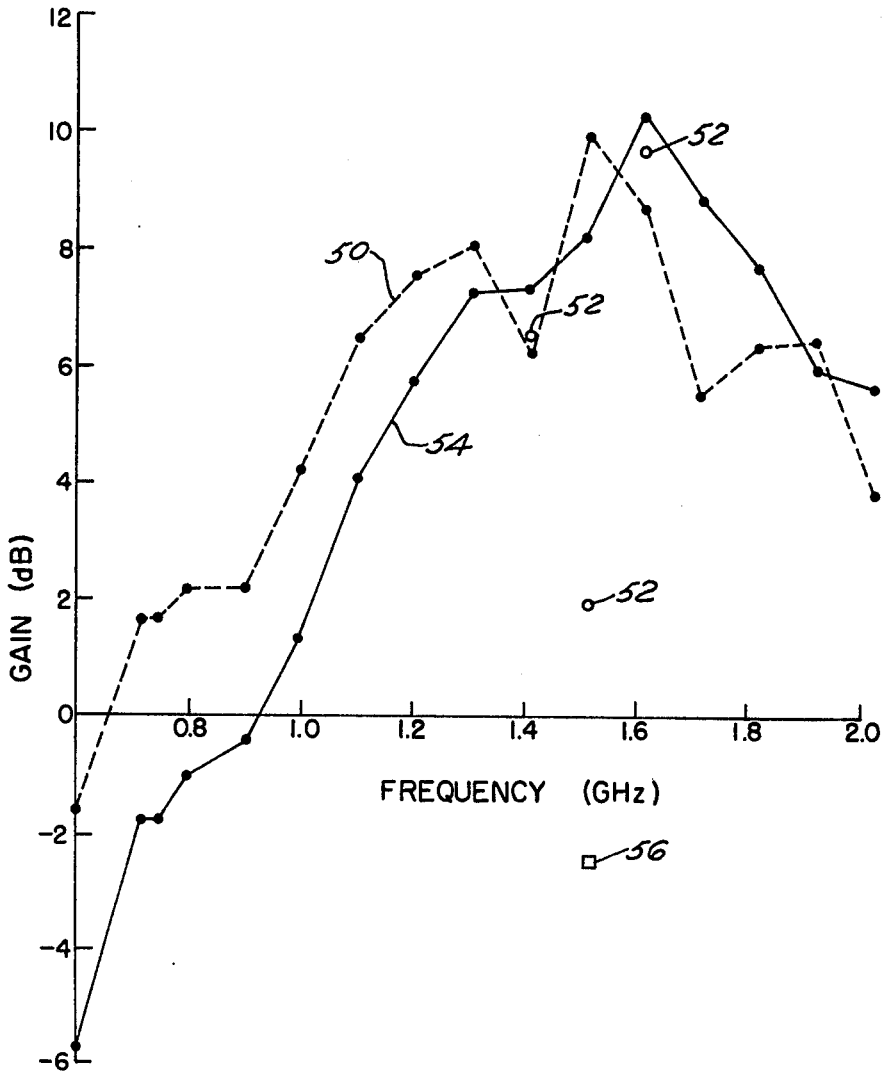
FIG. 3 shows a comparison of the absolute gain of differing size and arrangement configurations of the antenna of FIG. 1 to isotropic.
Figure 4:
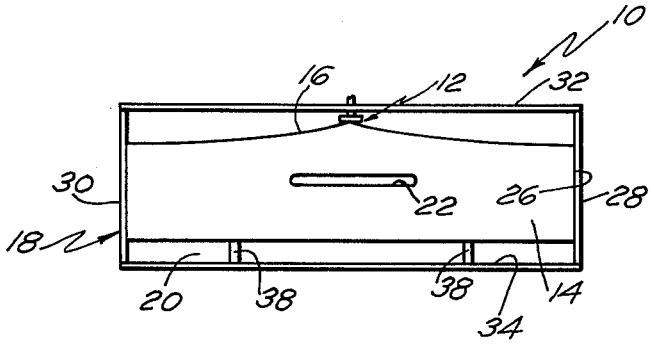
FIG. 4 is a front view of the T-bar fed slot antenna of FIG. 1.
Figure 5:
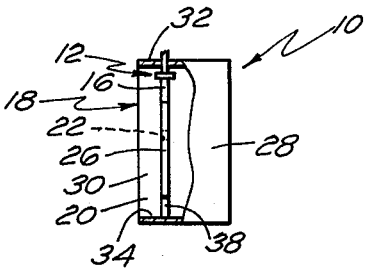
FIG. 5 is a partially cutaway side view of the T-bar fed slot antenna of FIG. 1.

FIG. 3 shows the absolute gain of a T-bar compared to isotropic for cavity depths of 2⅛ and 1½ inches. Curve 50 is for a cavity depth of 2⅛ inches with tuning. Points 52 are for a cavity depth of 2⅛ inches without tuning. Curve 54 is for a cavity depth of 1½ inches with tuning and point 56 is for a cavity depth of 1½ inches without tuning. FIGS. 4 annd 5 show additional views of antenna 10.

There has therefore been described a T-bar slot antenna with a bandwidth that can be increased by a factor of two over the conventional T-bar slot antenna design. Another improvement is that the depth of the antenna is capable of being significantly reduced from that required of previous designs. The improved T-bar fed slot antenna offers a viable solution to some unusual receiving design requirements.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A T-bar fed slot antenna comprising:

a rectangular waveguide segment forming a cavity; and a planar cross section T-bar having one side gradually sloping from its midpoint to its endpoints, said T-bar includes a slot centered between its ends said slot being generally parallel to a line joining said endpoints, the length of said slot is substantially one-half the wavelength of the upper endpoint of the frequency range.

2. A T-bar fed slot antenna comprising:

a rectangular waveguide segment forming a cavity; and a planar cross section T-bar having one side gradually sloping from its midpoint to its endpoints, said T-bar includes a slot centered between its end, the length of said slot is substantially one-half the wavelength of the upper endpoint of the frequency range; and a pair of tuning stubs separated by a wavelength of the frequency where the $TE_{30}$ mode is excited, the tuning stubs being located on opposite sides of the center of the T-bar, directly under the T-bar.

3. A T-bar fed slot antenna according to claim 2 wherein said slot is substantially rectangular with rounded corners.

4. A T-bar fed slot antenna according to claim 3 wherein the depth of said cavity is substantially one-fourth the wavelength of the highest frequency.

* * * * *